United States Patent [19]

Schaffer et al.

[11] 3,999,629

[45] Dec. 28, 1976

[54] FOLDABLE STEP STOOL

[75] Inventors: Irving Schaffer, Fairfield; Elliott J. Siff, Westport, both of Conn.

[73] Assignee: Marlene Designs, Inc., Bridgeport, Conn.

[22] Filed: Oct. 6, 1975

[21] Appl. No.: 619,860

[52] U.S. Cl. ..... 182/156; 182/125

[51] Int. Cl.[2] ..... E06C 1/387

[58] Field of Search ..... 182/156, 154, 33, 28, 182/29, 31, 125; 108/120; 297/57

[56] References Cited

UNITED STATES PATENTS

| | | | |
|---|---|---|---|
| 606,845 | 7/1898 | Simmons | 108/120 |
| 1,217,772 | 2/1917 | Kade | 108/120 |
| 1,295,073 | 2/1919 | Schwartz | 182/154 |
| 2,802,578 | 8/1957 | Barile | 108/120 |
| 2,947,588 | 8/1960 | Friedenreich | 108/120 |

*Primary Examiner*—Reinalde P. Machado
*Attorney, Agent, or Firm*—Francis L. Masselle

[57] ABSTRACT

A foldable step stool comprises a pair of rectangular frame members, one disposed within the other and having pivotally connected side rails thus permitting the members to assume an open position, in which the side rails intersect in an "X"-configuration, and a closed position in which the inner frame is contained entirely within the outer frame. Two steps extend between the side rails of the frame members, the ends of one step being pivotally secured to the side rails of the inner frame member and having a pin-and-slot connections to the side rails of the outer frame member. The second step is similarly arranged with the pivotal and pin-and-slot connections reversed with respect to the inner and outer frame members. When in the closed position, the steps lie completely within the three dimensions of the outer frame member.

9 Claims, 5 Drawing Figures

FOLDABLE STEP STOOL

BACKGROUND OF THE INVENTION

1. Field of the Invention

This invention relates generally to foldable support structures and in particular to household step stools and/or step ladders.

2. Summary of the Prior Art

The well-recognized utility and convenience of step stools for household use is offset to a considerable degree by the lack of a suitable place for their storage in the average home. While most such stools are easily foldable, even in folded condition they occupy sufficient space, typically four to eight inches in the thickness dimension, that they either must be stored in the basement or garage, where they are not near at hand to the kitchen or other rooms in which they are most frequently needed, or they must compete with, and exclude from a convenient storage closet, other household implements (e.g., ironing board, vacuum cleaner, etc.).

Aside from the problem of storage, the desirability of minimizing the folded size of step stools has long been recognized for other reasons and considerable effort devoted to achieving compactness. Thus, for example, U.S. Pat. No. 3,059,722 points out the importance of achieving a sufficient degree of compactness to comply with carton-size limitations imposed on U.S. Parcel Post shipments and/or to avoid the necessity of packing step stools in disassembled or partially assembled form, the latter alternative being highly undesirable from the marketing standpoint.

Further examples of folding arrangements for step stools are shown in U.S. Pat. Nos. 2,952,301: 3,011,585 and 3,058,544, but in each case the effect of folding is simply to reduce the volume occupied by the structure whereas the present invention provides a construction in which folding reduces the volume occupied to a practical minimum, viz., that of the largest single structural component.

Another shortcoming of prior art step stools is that whatever compactness is achieved in folding is attained by resort to relatively complex structures, usually involving several pivotal links, with attendant loss of rigidity/stability and increases in manufacturing cost and, therefore, selling price. In contrast, the present invention contemplates a step stool which, in its two-step form, has only four relatively movable parts, two being the steps themselves, and no pivotal links, hangers, or braces.

It is, therefore, a general object of the invention to provide a novel step stool which overcomes or mitigates at least some of the problems of comparable prior art devices as discussed above.

A primary specific object is the provision of a step stool which folds to occupy a space no larger in any dimension than its largest component member.

Another object is to provide a step stool which can be stored in a very narrow space such as a single slot of a tray cupboard.

A further object is the provision of an improved step stool fulfilling the preceding objects in a structure which is susceptible of low-cost manufacture, is easily opened and closed, and provides a very stable unit when erected.

SUMMARY OF THE INVENTION

To the fulfillment of the foregoing and further objects and the attainment of many advantages over prior art devices, which will become apparent as this description proceeds, the invention contemplates a foldable step stool comprising first and second frame members of rectangular configuration each made up of parallel side rails and cross brace rods extending between the side rails. The rails and braces of each frame member define and occupy a planar volume of uniform thickness, the second frame member being disposed within, and with its respective side rails pivotally secured to the side rails of, the first frame member. No dimension of the second frame member is greater than the corresponding dimension of the first frame member so that the frame members may be pivoted to a closed position in which the second frame member is wholly contained within the planar volume of the first frame member. First and second step members extend between, and in planes perpendicular to, the side rails of the frame members; the ends of each step are pivotally secured to one frame member and have a pin-and-slot connection to the other frame member, whereby the step members are disposed in vertically spaced horizontal planes when the frame members are pivoted to an open position, wherein the side rails intersect in an "X"- configuration, and are disposed wholly within the planar volume of the first frame member when the frame members are pivoted to said closed position.

DESCRIPTION OF A PREFERRED EMBODIMENT

Figure 1:
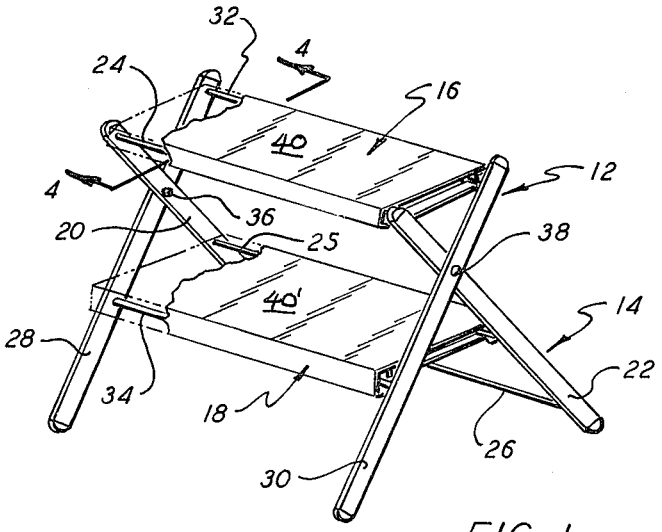
FIG. 1 is a perspective view of a step stool embodying the present invention.

Referring now to the drawings, a two-step version of a foldable step stool according to the present invention is shown in perspective in FIG. 1 in open position; in this illustrated embodiment, the stool is made up of four relatively movable major components: an outer frame member 12; an inner frame member 14; an upper step 16; and a lower step 18.

Each frame member is of rectangular configuration and is made up of parallel side rails and cross brace rods. Thus, inner frame member 14 has parallel side rails 20, 22 interconnected at respective ends by cross brace rods 24 and 26 and, at generally their midpoints, by an intermediate cross brace rod 25. Similarly, outer frame member 12 has parallel side rails 28, 30 interconnected by cross brace rods 32, 34, one (32) at the upper ends of the side rails and the other (34) at approximately one-third the distance from their lower ends. As will become apparent from the ensuing description, each frame member may have additional cross brace rods, depending on the particular construction selected, provided that they do not interfere with the opening and closing of the stool.

Inner frame member 14 is slightly narrower and, in all other dimensions smaller, than outer frame member 12, permitting the inner frame to be disposed within the outer frame with the respective side rails parallel. A pivotal connection 36 between side rails 20 and 28 and a pivotal connection 38 between side rails 22 and 30 define a transverse pivotal axis. Pivotal connections 36, 38 may be formed by means of a rivet or nut and bolt assembly (as shown) passed through suitable holes in the side rails.

Figure 2:
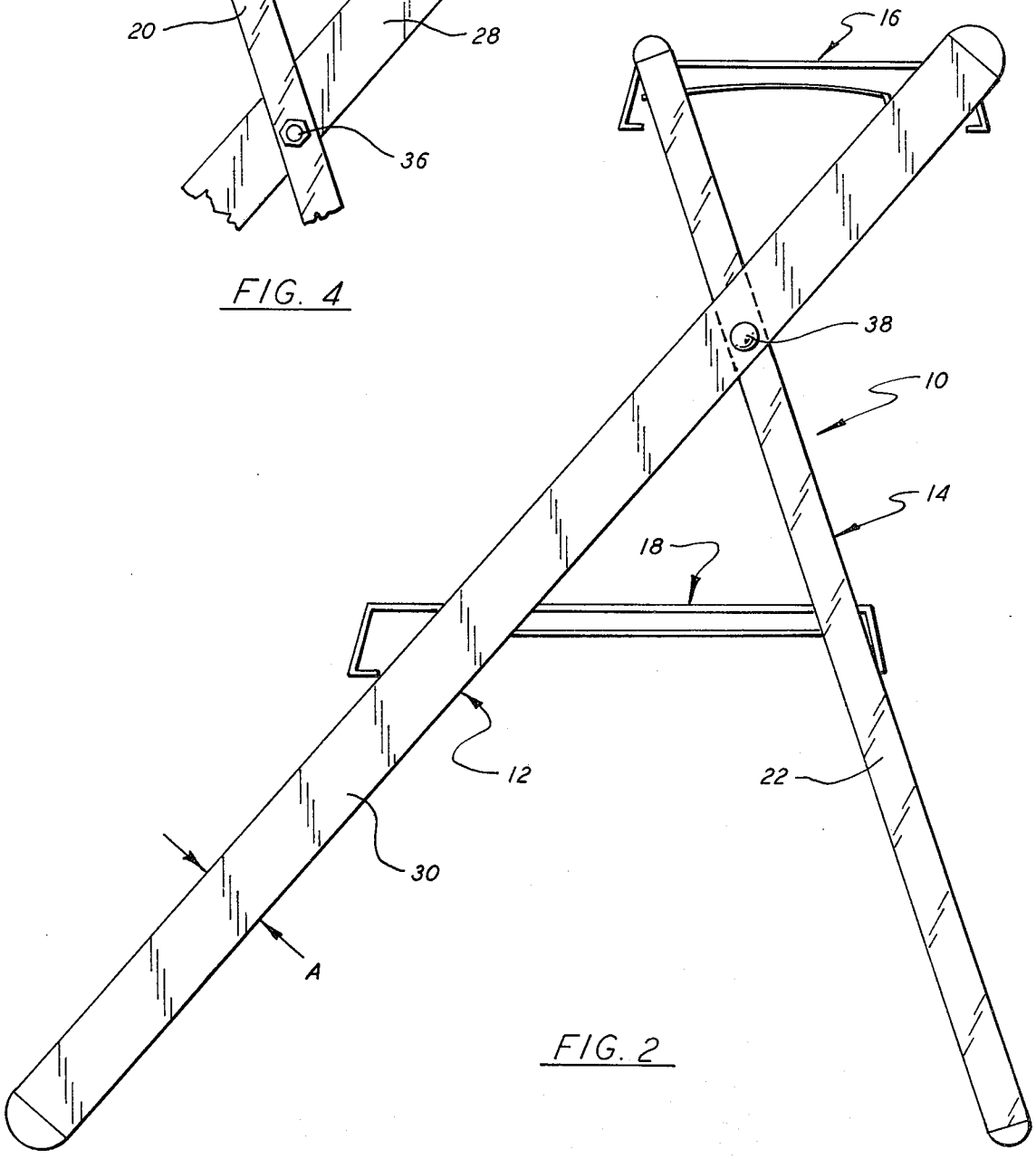
FIG. 2 is a side elevational view of the step stool of FIG. 1.

In order to achieve a high degree of stability, the pivotal connections 36, 38 are preferably located at the upper one-third to one-fourth of the length of side rails 28, 30 of outer frame member 12, as best appears in FIG. 2. This location, coupled with the fact that at least the portion of the inner frame side rails below the pivots are shorter than those of the outer frame, gives the opened structure a wide base and achieves excellent distribution of imposed weight. This arrangement also enables the use of a deeper, forwardly projecting lower step which can be used as a foot rest when sitting on the upper step.

Figure 5:
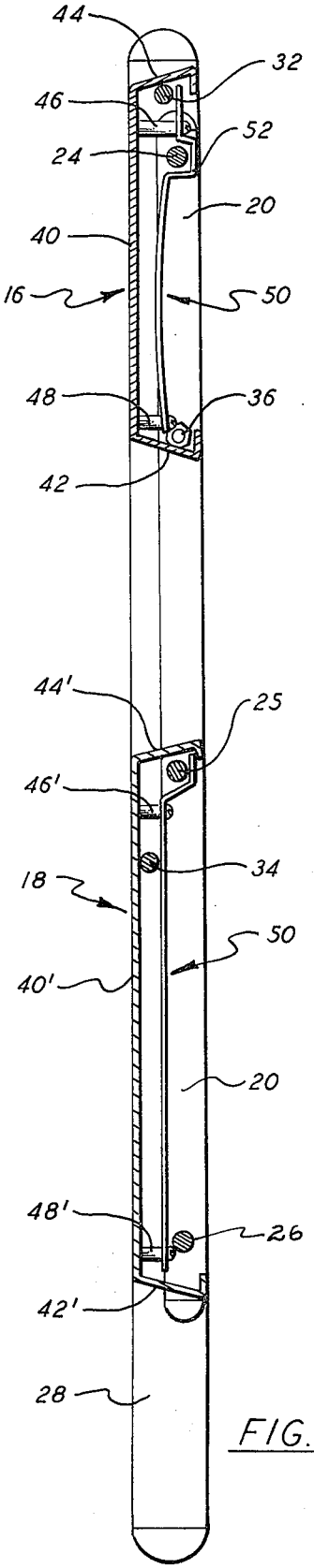
FIG. 5 is a sectional view on line 5—5 of FIG. 3.
Figure 3:
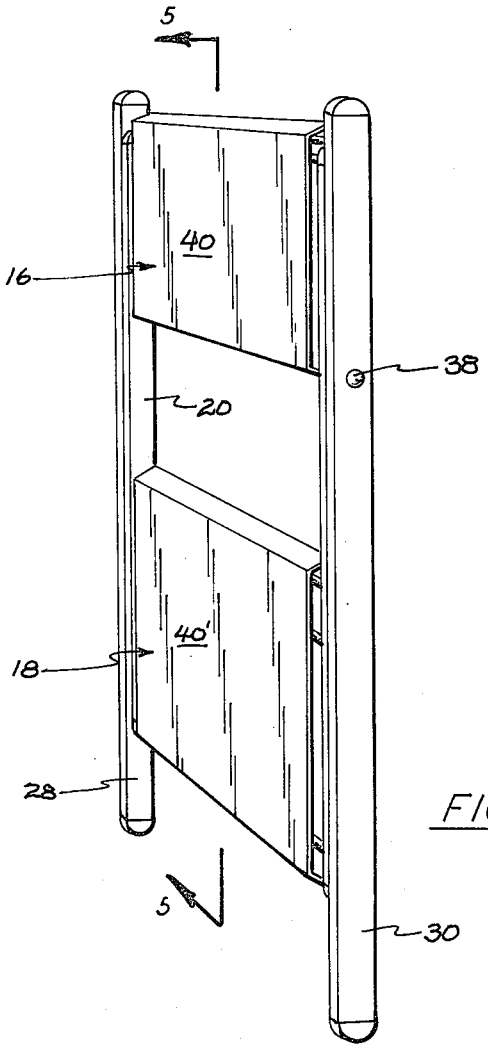
FIG. 3 is a perspective view of the step stool of FIG. 1 in closed position.

Frame members 12, 14 can pivot relative to one another about the transverse axis between an "open" position, shown in FIGS. 1 and 2, where the side rails intersect in an "X"-configuration, and a "closed" position, shown in FIGS. 3 and 5, where the inner frame lies entirely within the planar volume of the outer frame. As employed herein, the term planar volume is used to denote a plane having finite dimensions, including a finite thickness. Thus, it is important to note, the side rails and cross brace rods of outer frame member 12 define and occupy a planar volume having a thickness corresponding to the dimension of the side rails perpendicular to the planar volume. This dimension of outer frame side rails 28, 30, designated "A" in FIG. 2, establishes the thickness of the planar volume and is determined to large extent by the nature of the material, e.g., wood or metal, of which the side rails are constructed and is selected to give the structure adequate strength and rigidity, with a suitable factor of safety. It has been found in actual practice that dimension "A" can typically be approximately 1 inch wide when the side rails are formed of hollow mild steel 1 inch × ½ inch box sections. With this design parameter established, the side rails of inner frame member 14 would be ⅝ × 178 inch box sections; thus the dimension "A" of the outer frame exceeds the corresponding dimension of the inner frame by ⅜ inch. The significance of these dimensions and of the fact, best apparent from FIG. 2, that the pivotal connections 36, 38 are centered with respect to the longitudinal edges of the inner frame side rails but not the corresponding edges of the outer frame side rails, will become evident as this description proceeds.

As is best apparent from FIGS. 3 and 5, no dimension of the inner frame is larger than the corresponding dimension of the outer frame so that, as previously explained, the inner frame is contained entirely within a planar volume defined by the outer frame when the frames are in closed position.

The side rails of both the inner and outer frame members are provided with rounded rubber or plastic inserts at both top and bottom ends, serving to finish and shield the sharp edges of the box sections and provide a slip-resistant footing for the step stool.

Referring to FIGS. 1 and 5, step members 16 and 18 are mounted on the frame assembly by means of pivot and pin-and-slot connections, so that, with the frame assembly in open position, the step members are disposed in vertically spaced horizontal planes, horizontally offset in stair fashion. To this end, and in the interest of achieving maximum stability, the pivot points between the frame members, defined by bolt assemblies 36, 38 are located much closer to the top than the bottom ends of the side rails. In the illustrated embodiments, the pivot points are approximately half-way between the upper ends and the midpoints of the side rails or, put another way, 25% of the length of the side rails from their upper ends.

In a manner to be described in detail presently, each of the steps 16 and 18 is pivotally connected to a respective one of the frame members 12, 14 and coupled to the other frame member by a pin-and-slot type connection. Specifically, upper step 16 is pivoted at its rearward edge on the upper cross brace rod 32 of outer frame member 12 and has a slidable connection with the upper cross brace rod 24 of the inner frame member 14, the cross brace constituting the "pin" of the pin-and-slot coupling. Similarly, lower step 18 pivots at its rearward edge about the middle cross brace rod, 25, of the inner frame and forms a pin-and-slot connection with cross rod 34 of the outer frame.

Figure 4:
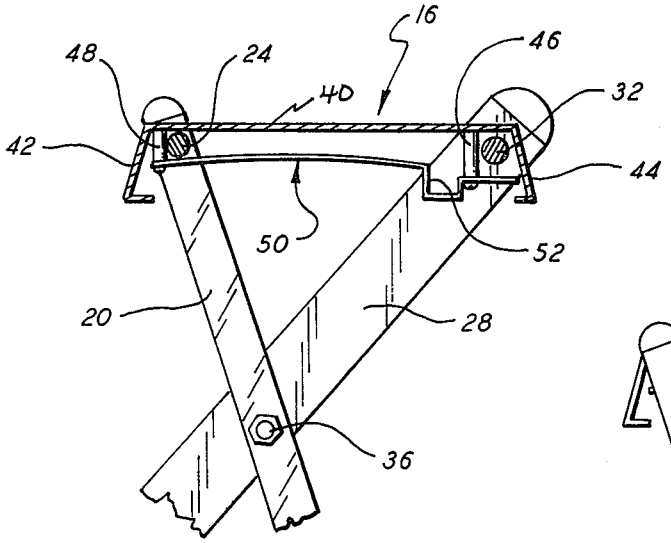
FIG. 4 is a fragmentary sectional view on line 4—4 of FIG. 1.

As the manner of mounting the steps on the frame assembly is very similar for both the upper and the lower steps, only the upper step mounting need and will be described in detail, with particular reference to FIG. 4. (Corresponding mounting structure for the lower step appears in FIG. 5 where counterparts are designated by corresponding primed reference numerals.) Shown in cross-section in FIG. 4, it will be seen that upper step 16 (and, of course, lower step 18 as well) is fabricated of a metal plate formed to provide a flat tread portion 40 and down-turned front and rear flanges 42, 44, respectively, which in addition to improving the aesthetics of the construction and eliminating exposed sharp edges, lend strength and rigidity to the step member. This construction also contributes importantly to the compact foldability of the step stool as will become apparent from the ensuing description.

Adjacent the rear flange 44, the underside of tread portion 40 carries a dependent projection 46 which may take the form of a continuous rib extending along substantially the entire width of the step or may be one of two individual bosses at the respective ends of the step. Adjacent the forward edge flange 42 is another dependent projection 48 which, like 46, may be formed as a continuous rib or two individual bosses. Fastened to projections 46 and 48 adjacent each end of step 18, as by means of screws threaded into the projections, are metal straps, one shown at 50. Strap 50, like its identical counterpart at the other end of step 18, extends between the front and rear edges of the step and, in cooperation with the underside of its tread portion 40 forms a slot or channel in which cross brace rod 48 is slidable disposed to form the aforementioned pin-and-slot connection. The rearward end of strap 50 coacts with rear flange 44 and projection 46 to provide a journal for cross rod 32 and thus define the pivotal connection already referred to.

Strap 50 and its counterpart have a profile configuration that provides, adjacent boss or rib 46, a trough 52 which accommodates cross brace rod 24 when the step stool is folded, as will be described presently. Moreover, the segment of strap 50 between boss 48 and trough 52 is bowed slightly toward the underside of step tread portion 40 so as to limit the width of the slot to a dimension slightly smaller than the diameter of rod 24. The presence of trough 52 facilitates the small amount of downward flexure of strap 50 required to permit passage of cross brace rod 24 through the slot when the stool is opened or closed. In this manner, moderate frictional resistance is created to prevent sudden uncontrolled movement which might cause the user's fingers to be caught between moving parts when opening or closing the step stool.

By inspection of the step stool as reviewed from the side (FIGS. 1 and 2), it will be seen that an inherently stable structure is provided in the open condition. Placing weight on the steps tends to lock the frames in place. To fold the stool it is only necessary to press the lower ends of the frames toward each other. This causes the rod 24 to move rearwardly in its slot until it enters trough 52; at the same time, rod 34 moves rearwardly in its slot. In each case, the forward edges of both steps fold downwardly, the steps pivoting about rods 32 and 25, until they lie completely within the planar volume of the outer frame. From FIG. 5 it will be seen that the difference between the thickness dimension of the inner and outer frame side rails, coupled with the offset of the pivots 36, 38, both previously alluded to, accommodate rod 34 when the structure is folded. The reverse procedure may be used to erect the stool.

In its folded condition, the stool described is only one inch wide and thus can easily be stored in narrow spaces not normally used otherwise, such as between the refrigerator and adjoining wall or kitchen base cabinet, or it may be hung on the wall or on the side of a kitchen cabinet. And, as previously mentioned, it can be slipped into a tray cupboard. In this connection it is pointed out that the over-all length and width dimension of the folded unit are comparable to those of a tray, i. e., 18 × 22 inches, in the illustrated two-step version. The principles of the invention can, of course, be applied to stools with more than two steps.

Because of its light weight, small size and planar shape in the folded condition, it is perfectly feasible to carry the unit for use at sporting events, picnics, and other places where fixed seating may not be available.

From the preceding description of a preferred embodiment of the invention, it will be apparent to persons conversant with the art that various modifications may be made without departing from the scope of the invention as defined in the following claims.

What is claimed is:

1. A foldable support structure, comprising:

a. first and second rectangular frame members each made up of parallel side rails and cross braces extending between the side rails, said second frame member being disposed within, and with its side rails pivotally connected to the side rails of, said first frame member whereby the frame members can pivot relative to one another between a closed position in which they are substantially co-planar and an open position in which the respective side rails intersect in an "X"-configuration, the side rails and braces of said first member defining and occupying a planar volume of uniform thickness dimension, no dimension of the second frame member being greater than the corresponding dimension of the first frame member, thus causing the second frame member to be contained entirely within the planar volume of the first frame member when the frame members are in the closed position; and b. first and second step members extending between, and in planes perpendicular to, the side rails of said frame members, the ends of each step being pivotally connected to a respective frame member and having a pin-and-slot connection to the other frame member, whereby the step members are disposed in vertically spaced horizontal planes when the frame members are in said open position and are disposed wholly within the planar volume of the first frame member when the frame members are in said closed position.

2. A foldable support structure according to claim 1 wherein said uniform thickness dimension of the planar volume of said first frame member, established by the dimension perpendicular to the planar volume of the side rails of the first frame member, is not significantly greater than required by the material of construction to achieve adequate strength and rigidity.

3. A foldable support structure according to claim 2 wherein said thickness dimension is approximately one inch.

4. A foldable support structure according to claim 1 wherein:

a. said horizontal plane of the first step member is disposed above, and said horizontal plane of the second step member disposed below, the pivotal connection of the side rails of the first and second frame members;

b. the pivotal connections of the first and second step members are to the first and second frame members respectively and define respective pivotal axes parallel to and proximate the rearward edges of the step members; and c. the pin-and-slot connections of the first and second step members are to the second and first frame members, respectively, and are defined by respective cross braces of the frame members slidably engaged in respective slots adjacent each end of the step members, each slot extending from a point adjacent the forward edge of the respective step member and terminating short of its pivotal connection to a frame member.

5. A foldable support structure according to claim 4 wherein the slots of the pin-and-slot connection of at least one of said step members are configured to impose frictional restraint on movement of the pin in the slot.

6. A foldable support structure according to claim 1 wherein:

a. said first step member is disposed above, and said second step member below, the pivotal connection of the side rails of the first and second frame members;

b. the pivotal connection of the first step member is to the first frame member and defines a pivotal axis parallel to and proximate the rearward edge of the first step member;

c. the pin-and-slot connection of the first step member is to the second frame member and defined by a cross brace of the second frame member slidably engaged in respective slots adjacent each end of the first step member extending from a point adjacent the forward edge of the step member and terminating short of said pivotal connection of the first step member;

d. the pivotal connection of the second step member is to the second frame member and defines a second pivotal axis parallel to and proximate the rearward edge of the second step member; and e. The pin-and-slot connection of the second step member is to the first frame member and defined by a cross brace member of the first frame member slidably engaged in respective slots adjacent each end of the second step member extending from a point adjacent the forward edge of the step member and terminating short of said pivotal connection of the second step member.

7. A foldable support structure according to claim 6 wherein said pivotal axis and second pivotal axis coincide with, and are defined by, respective cross braces of said second and first frame members.

8. A foldable support structure according to claim 7 wherein:

a. said pivotal connection between the side rails is located approximately one-third to one-fourth the distance from the upper end of the first frame member side rails; and b. at least the portion of the second frame member side rails below said pivotal connection is substantially shorter than the corresponding portion of the first frame member said rails.

9. A foldable support structure according to claim 7 wherein the second frame member side rails have a transverse dimension perpendicular to the axis of said pivotal connections which is substantially smaller than the corresponding dimension of the first frame member side rails, said pivotal connections being centered with respect to the said dimension of the second frame member side rails and offset from center with respect to said corresponding dimension of the first frame member side rails, the difference in said dimensions and the amount of said offset being sufficient to avoid interference with said cross braces when said frames are in the closed position.

* * * * *